United States Patent [19]

Carrera et al.

[11] 4,273,337

[45] Jun. 16, 1981

[54] FAMILY SEX EDUCATION BOARD GAME

[76] Inventors: Michael A. Carrera; June F. Carrera, both of 444 E. 82nd St., New York, N.Y. 10028; Melvyn S. Littner; Lorna C. Littner, both of 52 W. 57th St., New York, N.Y. 10019

[21] Appl. No.: 83,877

[22] Filed: Oct. 11, 1979

[51] Int. Cl.[3] ..... A63F 3/00

[52] U.S. Cl. ..... 273/243; 273/DIG. 26

[58] Field of Search ..... 273/243, 248, 249

[56] References Cited

U.S. PATENT DOCUMENTS

| | | | |
|---|---|---|---|
| D. 213,208 | 1/1969 | Beer | 273/243 |
| D. 218,692 | 9/1970 | McSweeney | 273/249 |
| 2,717,156 | 9/1955 | Nelson | 273/248 |
| 3,104,106 | 9/1963 | Kenney | 273/249 |

FOREIGN PATENT DOCUMENTS

| | | | |
|---|---|---|---|
| 231281 | 2/1959 | Australia | 273/243 |
| 867150 | 5/1961 | United Kingdom | 273/249 |

*Primary Examiner*—Richard C. Pinkham
*Assistant Examiner*—Carl Moy
*Attorney, Agent, or Firm*—Allison C. Collard; Thomas M. Galgano

[57] ABSTRACT

A board game apparatus is provided which is intended to facilitate communication between parents and children regarding facts and attitudes in the area of human sexuality and to provide learning experiences which will lead to improved communication between parents and their children and adults and young people. The apparatus includes a plurality of player tokens, a game board having a closed continuous path defined by a multiplicity of playing spaces, and three decks of cards, each of which contains questions concerning the field of human sexuality; the decks being distinguishable from one another according to degree of difficulty. There is also provided a fourth deck of cards which contains discussion questions for duscussing various attitudes concerning human sexuality and a score sheet for scoring one's correct answers according to category.

8 Claims, 10 Drawing Figures

Fig.3
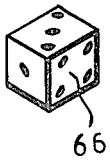
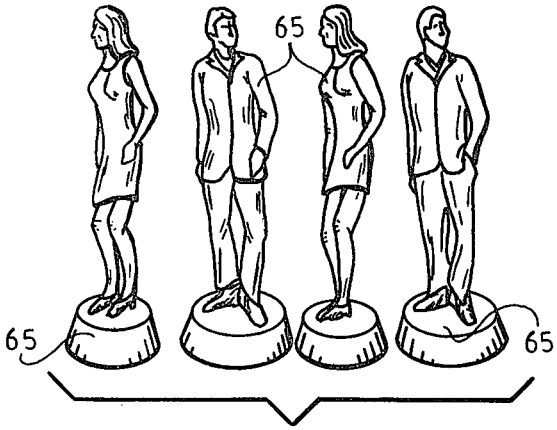
Fig.2
Fig.6
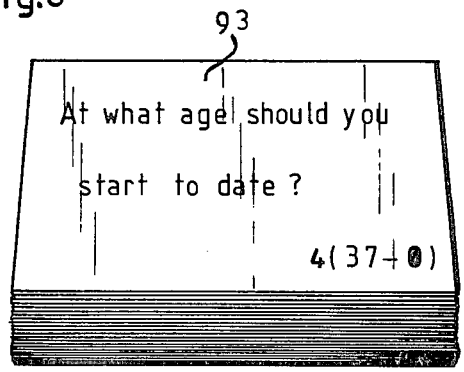
Fig.4
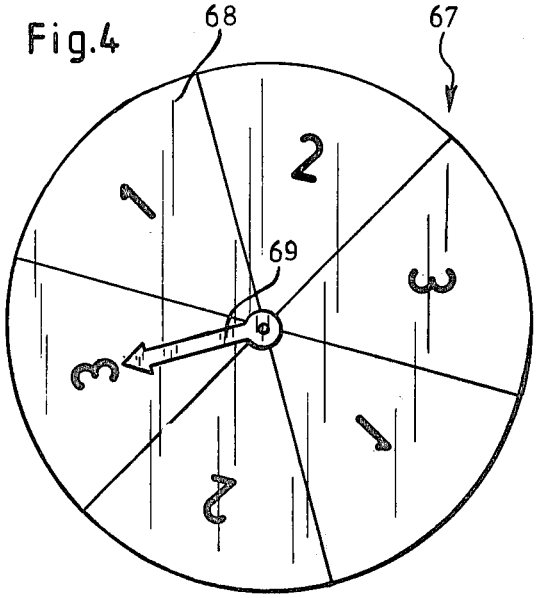
Fig.5
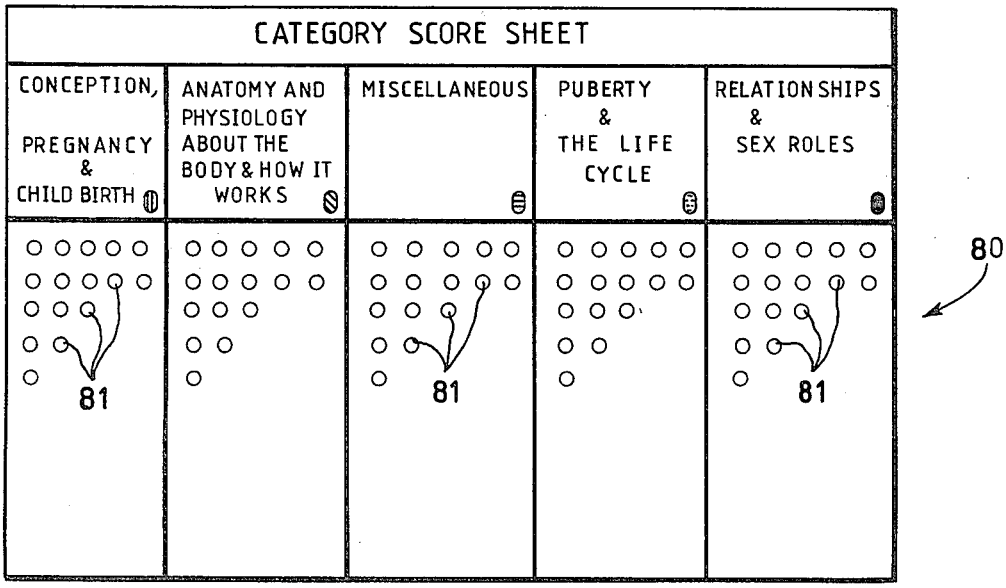

True or False
Babies come from a large bird called the STORK.
1(8-0)
90
The sperm travels to the egg by
A. flying
B. walking
C. swimming
2(1-0)
91
What does the picture on square *25 reprensent ?
3(39-0)
92

95
BONUS 82
94
ANSWER BOOK

FAMILY SEX EDUCATION BOARD GAME

The present invention relates to a board game apparatus. More particularly, it relates to a board game apparatus which is intended to facilitate communication between parents and children regarding facts and attitudes in the area of human sexuality.

Board and parlor games which are used to simulate various aspects of both real and imaginary experiences are, of course, well known and widely used both for entertainment as well as educational purposes. For example, there is the well known Monopoly board game (see U.S. Pat. No. 2,026,082), wherein the players attempt to build real estate monopolies and divest their opponents of their real estate holdings and cash assets. There has also been proposed an antitrust prosecuting board game (see U.S. Pat. No. 3,961,795), wherein the object is to break up monopolies rather than build them.

Other board games have been proposed which attempt to simulate other real life experiences in the area of personal development (see e.g., U.S. Pat. No. 3,759,521), as well as in the fields of business, government, etc. However, so far as is known, no board game apparatus is presently available which provides learning experiences which will lead to improved communication between parents and their children and adults and young people. Moreover, no board game apparatus of this type is known which is especially intended as an entertaining instructional aid for children which promotes their awareness of the facts and attitudes concerning human sexuality in a relatively simple and yet highly effective manner as herein proposed.

Accordingly, it is an object of the present invention to provide a novel board game apparatus especially designed for children which serves to promote their awareness of facts and attitudes concerning human sexuality.

It is also an object of the present invention to provide such a novel board game apparatus which is both entertaining as well as educational.

It is a further object of the present invention to provide such a novel board game which is relatively easy and simple to play, and which may be economically fabricated.

Certain of the foregoing and related objects are readily attained in a sex education board game apparatus, which includes a plurality of tokens, each of which represent one of the players, and a game board having a playing field and a multiplicity of playing spaces formed on the playing field which cooperatively define a path along which the tokens are movable in random increments. The playing spaces include a starting and finishing space and at least four different sets of spaces; a first set of spaces interspersed along the path having instructions thereon concerning the loss of a turn; a second, third and fourth set of spaces interspersed along the path, each of which has identical indicia thereon which is different from the indicia on the other sets. The apparatus also includes three decks of cards, the cards of which each bear a question concerning the field of human sexuality. The cards in the same deck having question of relatively the same difficulty, and cards in each deck having a different degree if difficulty.

In addition, there is a fourth deck of cards associated with the fourth set of playing spaces, each of which contain a question for discussion among the players which also concerns the field of human sexuality. There is also a fifth deck of "Bonus" cards that are associated with both the fifth set of playing spaces and the category peg board.

A spinner device is associated with the second and third sets of playing spaces. It includes a base plate having a plurality of radially arranged sector-shaped spaces thereon, each of which bear a number concerning movement of the player's token which lands on one of the spaces of the second or third sets and a spinner rotatably mounted on the base plate for randomly selecting one of the spaces on the base plate. An answer booklet contains the answers to the questions set forth in the four decks of cards, and a category score sheets (preferably in the form of a peg board) for scoring one's correct answers according to various categories of human sexuality are also included.

Preferably, the board game apparatus additionally includes a random number generator, such as a die, for determining the order of play among the players. Most advantageously, the game board has four boxes delineated in the center thereof for receipt therein of the four decks of cards. Most desirably, the cards of the different decks are colored differently and are sequentially numbered. Most desirably, there are six spinner devices spaces sequentially numbered 1, 2, 3 (the numbers being repeated) and these numbered spaces 1, 2, and 3 are preferably color coordinated with the first, second and third decks of cards respectively. Finally, it is also advantageous if the category score sheet is divided into a plurality of columns which bear different category headings concerning human sexuality.

Other objects and features of the present invention will become apparent from the following detailed description, considered in connection with the accompanying drawings, which disclose one embodiment of the invention. It is to be understood, however, that the drawing is designed for the purpose of illustration only, and not as a definition of the limits of the invention.

In the drawings, wherein similar reference characters denote similar elements throughout the several views:

FIG. 2 is a perspective view of four tokens used as playing pieces to represent each of the players;

FIG. 3 is a perspective view of a die used in association with the game board;

FIG. 4 is a top plan view of a spinner device used in association with the game board;

FIG. 5 is a top plan view of a category score sheet used in association with the game board;

FIG. 6 is a perspective view of a deck of discussion cards used in association with the game board;

Figure 1:
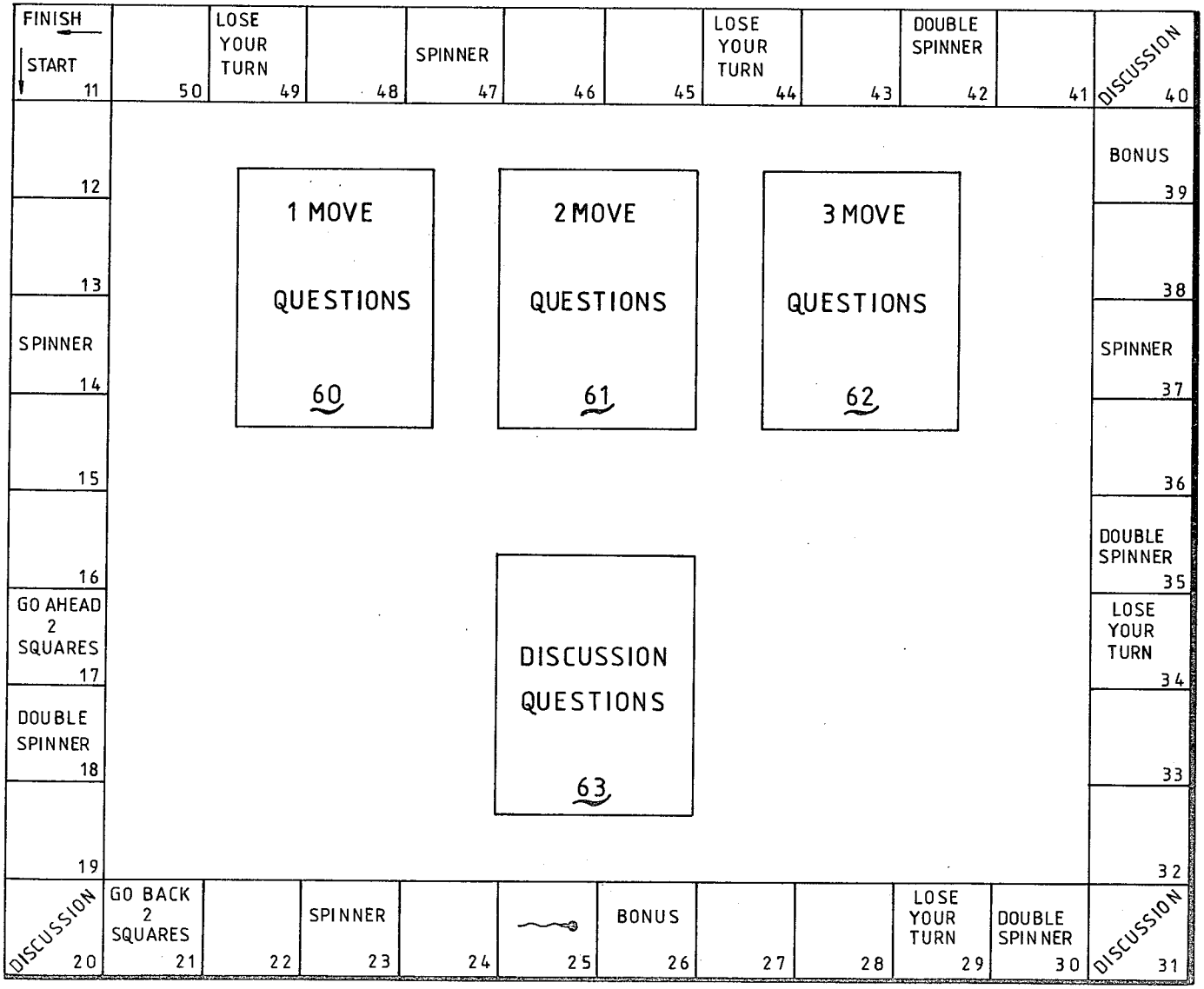
FIG. 1 is a top plan view of a game board used in association with the novel board game apparatus embodying the present invention.

Referring now in detail to the drawings and, in particular, FIG. 1 thereof, therein illustrated is a novel board game apparatus embodying the present invention which includes a flat game board 10 which preferably has a square or rectangular shape. Game board 10 has delineated thereon a closed, continuous path defined by a multiplicity of consecutive playing spaces or squares arranged about the periphery thereof.

Board 10 consists of a total of forty consecutively numbered spaces 11–50, including a corner starting and finishing space 11 labeled "Start" and "Finish". Interspersed along the playing path are four spaces 29, 34, 44, and 49 labeled "LOSE YOUR TURN". In addition, there is a playing space 21 labeled "GO BACK 2 SQUARES", and a playing space 17 labeled "GO AHEAD 2 SQUARES". There is also a set of four spaces 14, 23, 37, and 47 labeled "SPINNER", a set of four spaces 18, 30, 35, and 42 labeled "DOUBLE SPINNER", and three corner spaces 20, 30 and 40 labeled "DISCUSSION".

There are also two spaces 26 and 39 labeled "BONUS". The remaining spaces 12, 13, 15, 16, 19, 22, 24, 25, 27, 28, 32, 33, 36, 38, 41, 43, 45, 46, 48, and 50 are intended to have pictures or photographs imprinted thereon. Space 25 is provided with such a picture but the other spaces have been left blank for the purpose of clarity.

In the center of the board, there are four boxes, 60, 61, 62, and 63 labeled "1 MOVE QUESTIONS", "2 MOVE QUESTIONS", "3 MOVE QUESTIONS", and "DISCUSSION QUESTIONS", respectively (the purpose of the various playing spaces will be described in greater detail hereinafter).

Each of the players is represented by a preferably plastic playing piece, marker or token 65 for registering movement along the playing path, four of which are shown in FIG. 2. Each token 65 is of a different color, (e.g., red, blue, yellow, green, etc.) so that each player's movement along the path may be readily identified without confusion. It should, of course, be appreciated that instead of employing tokens simulating male and female figures, other types of tokens may be employed so long as they are readily distinguishable from one another, such as by color, configuration, etc.

Any suitable random number generating means may be included with the game for determining the order of play among the players. Preferably, a die 66 (FIG. 3) is employed. As is customary, the person throwing the highest number goes first, the second highest number goes second, etc.

The board game apparatus further includes a spinner device 67 which includes a circular base plate 68 which is divided into six radially-disposed, colored, sector-shaped spaces, each of which contain a number (i.e., 1, 2 or 3) which provides instructions as to the movement of a player's token. Rotatably secured to the center of base plate 68 is a spinner 69 in the form of a directional arrow which is spun by the player so that it randomly points to one of the sector-shaped spaces of base plate 68. There is also provided, with the board game apparatus, a plurality of category score sheets 80, one of which is shown in FIG. 2. These sheets 80 are divided into five columns, each of which has a different column heading concerning a different area of human sexuality. Under each column, there are a multiplicity of peg holes 81 in which differently colored pegs 82 (FIG. 10) may be inserted. (The purpose of the category score sheet 80, pegs 82, and the spinner 67 will be discussed in greater detail hereinafter).

There is also provided a deck of discussion cards 93 which are placed in a stack on box 63 imprinted on board 10. One of the discussion cards 93 is picked from the stack by a player when his token 65 lands on one of the "DISCUSSION" spaces 20, 31, and 40. Representative questions which are set forth in the deck of discussion cards 93 are listed below in Table I:

TABLE I

CONTENTS OF DISCUSSION CARDS

| CARD NO. | QUESTION |
|---|---|
| 1 | Is it all right for boys to cry? |
| 28 | Is it okay to accept candy from a stranger? |
| 33 | Why in some families do mothers and fathers not live together? |
| 36 | Why do some parents avoid telling their kids about sex? |
| 37 | At what age should you start to date? |
| 38 | Why do some parents not tell their daughters about menstruation? |
| 48 | Where was I before mommy and daddy were married? |
| 50 | Why do parents have difficulty in accepting their children as sexual beings? |
| 51 | Why do children have difficulty in accepting their parents as sexual beings? |

There is also an answer book 94 which contains concise possible responses to the discussion questions. The responses to the representative questions listed in Table I are listed below in Table II:

TABLE II

ANSWERS TO DISCUSSION QUESTIONS

| ANSWER TO QUESTION NO. | ANSWERS |
|---|---|
| 1 | One of the values of our American society is that it is all right for a boy to "fight but not to cry". In fact, all human beings need to express and share all of their feelings and emotions. Yes, it is all right for a boy to cry. |
| 28 | Sometimes there are people who might seem nice to children, but really maybe abuse them. Children cannot always tell the difference. To be safe, a child should never take things from strangers. |
| 33 | Sometimes people who get married decide that they no longer love each other enough to live together. People who feel this way often separate and live apart. |
| 36 | Some people are not comfortable talking about sex. Parents who feel this way usually do not discuss sex with their children. |
| 37 | The age at which boys and girls start to date varies a great deal. The factors that contribute to this variation are: community; parents' feelings; personal readiness; etc. |
| 38 | Sometimes parents are uncomfortable with any aspect of sexuality including menstruation. They avoid the topic. |
| 48 | Nowhere. Your development into a human being begins at conception, your actual life begins at birth. |
| 50 | Some of the reasons parents have difficulty seeing their children as sexual beings are:<br>1. Discomfort and unease with sexual matters in general.<br>2. Relating sexual feelings or interests of children as signifying the beginning of independence and adulthood of their child. Traditionally this has been a difficult area for parents and children to communicate about. |
| 51 | Some of the reasons children have difficulty in accepting their parents' sexuality are:<br>1. If this is not an area which can be discussed at home and if parents are not physically affectionate with each other, it is logical that children will not be |

TABLE II-continued

| ANSWERS TO DISCUSSION QUESTIONS | |
|---|---|
| ANSWER TO QUESTION NO. | ANSWERS |
| | able to imagine their parents as sexual. |

There are also three other decks of cards 90, 91, and 92 which are each placed in a stack on boxes 60, 61, and 62 respectively. Each of these decks of cards contain questions which are divided by deck into different levels of difficulty. The cards which are identified as "1 MOVE QUESTIONS" are the least difficult, the questions labeled "2 MOVE QUESTIONS" are moderately difficult, and the questions labeled "3 MOVE QUESTIONS" are the most difficult. Representative questions from the deck of "1 MOVE QUESTIONS" 90 are set forth below in Table III:

TABLE III

| CONTENTS OF 1 MOVE QUESTIONS | |
|---|---|
| CARD NO. | QUESTION |
| 8 | True or False. Babies come from a large bird called the stork. |
| 9 | True or False. Men can get pregnant just like women. |
| 10 | True or False. A baby can walk while it's inside the mother's uterus. |
| 11 | True or False. Boys usually begin their menstrual periods at puberty. |
| 12 | True or False. Brothers can marry their sisters when they grow up. |
| 13 | True or False. Girls can marry their fathers when they grow up. |
| 14 | True or False. Boys can marry their mothers when they grow up. |

The answers for these questions are also set forth in the answer book 94 and the answers to the representative "1 MOVE QUESTIONS" set forth in Table III are set forth below in TABLE IV:

TABLE IV

| ANSWERS TO 1 MOVE QUESTIONS | |
|---|---|
| CARD NO. | ANSWERS |
| 8 | False. Babies grow and develop, until they are ready for birth, inside their mother. |
| 9 | False. A man always helps to make a baby, but a man can never be pregnant or give birth to a baby. |
| 10 | False. A baby cannot walk inside the mother because there is not enough room, nor are the baby's legs developed enough for it to stand up. Some movement, like stretching and kicking of arms and legs, does occur in later stages. |
| 11 | False. Boys do not get a period. |
| 12 | False. Close members of the same family almost never get married. |
| 13 | False. Close members of the same family almost never get married. |
| 14 | False. Close members of the same family almost never get married. |

Listed below in Table V are representative questions from the deck 91 of "2 MOVE QUESTIONS":

TABLE V

| CONTENTS OF 2 MOVE QUESTIONS | |
|---|---|
| CARD NO. | QUESTION |
| 1 | The sperm travels to meet the egg by:<br>A. flying<br>B. walking |

TABLE V-continued

| CONTENTS OF 2 MOVE QUESTIONS | |
|---|---|
| CARD NO. | QUESTION |
| | C. swimming |
| 6 | True or False. Every boy and girl begin puberty at exactly the same age. |
| 17 | True or False. In order for a woman to give birth to a baby, she must have an operation. |
| 19 | Babies usually cry because:<br>A. crying is their way of telling they need something<br>B. they are just noisy<br>C. they want to be annoying |
| 22 | An unborn baby grows in a part of the mother's body called her:<br>A. stomach<br>B. womb<br>C. ovary |
| 23 | The name of the cell that the male contributes in order to start a new life is called:<br>A. brain cell<br>B. sperm cell<br>C. egg cell |
| 26 | True or False. You have to be married to become pregnant. |
| 28 | At what age can a boy help to make a baby?<br>A. any age<br>B. puberty<br>C. after age 20 |
| 29 | True or False. After birth, slapping a baby on the backside is to start the baby crying and help the baby start breathing. |
| 30 | True or False. The unborn baby eats food with its own mouth. |

Once again, the answers to the "2 MOVE QUESTIONS" are set forth in the answer booklet 94 and the answers to the representative "2 MOVE QUESTIONS" are set forth below in Table VI:

TABLE VI

| ANSWERS TO 2 MOVE QUESTIONS | |
|---|---|
| CARD NO. | ANSWER |
| 1 | C is correct. Sperm have the ability to swim by moving their tails.<br>A is incorrect. Sperm do not have wings and therefore cannot fly.<br>B is incorrect. Sperm do not have legs and therefore cannot walk. |
| 6 | False. There is a wide age range during which boys and girls begin puberty. The approximate age range is 9–16 years. |
| 17 | False. Most women have their babies without an operation. |
| 19 | A is correct. Crying is a baby's way of communicating its need.<br>B is incorrect. Crying is a baby's way of getting attention. They do not cry just to make noise.<br>C is incorrect. Crying is a baby's way of getting attention. They do not cry just to be annoying. |
| 22 | B is correct. Baby grows inside the mother's uterus or womb.<br>A is incorrect. The stomach is an organ involved in digestion. Although is appears as if the baby is developing here, it is really the uterus or womb that is getting larger and growing upward toward the stomach.<br>C is incorrect. Eggs develop in the ovary, not babies. |
| 23 | B is correct. A sperm is very tiny and can only be seen under a microscope. When a male sperm cell meets and enters a female egg cell, a new life is started.<br>A is incorrect. Brain cells are not involved in the process of starting a new life.<br>C is incorrect. Egg cells are females' contribution to the start of a new life. |

TABLE VI-continued

| ANSWERS TO 2 MOVE QUESTIONS | |
|---|---|
| CARD NO. | ANSWER |
| 26 | False. A girl or woman can get pregnant even if she is not married. |
| 28 | B is correct. A boy is physically capable of helping to make a baby as soon as he has gone through puberty.<br>A is incorrect. A boy must first go through puberty before he is physically able to help in the production of a baby.<br>C is incorrect. Most boys have gone through puberty before the age of 20 and are therefore physically able to help in the production of making babies at a much earlier age. |
| 29 | True. A newborn must be helped to begin the process of breathing. A slap on the behind is one way of starting the baby to cry and breathe. |
| 30 | False. The baby gets its food through the umbilical cord which is its connection to the mother. |

The representative questions from the deck of "3 MOVE QUESTIONS" 92 are set forth below in Table VII:

TABLE VII

| CONTENTS OF 3 MOVE QUESTIONS | |
|---|---|
| CARD NO. | QUESTION |
| 7 | True or False. Most young people get their sex information from their friends. |
| 8 | True or False. Boys and girls should begin to talk with their parents about sex at the time of puberty. |
| 14 | The main reason puberty begins is:<br>A. nobody knows<br>B. hormones<br>C. none of these |
| 23 | The place where the umbilical cord is cut on each person is called a:<br>A. navel<br>B. big toe<br>C. placenta |
| 31 | Some babies are born with mental or physical illness. This is due to:<br>A. Problems the baby had in the uterus of the mother.<br>B. Heredity.<br>C. Both A and B are correct. |
| 32 | A premature baby grows and becomes healthy with the help of a machine called:<br>A. an incubator<br>B. heart lung machine<br>C. x-ray machine |
| 33 | In the uterus the unborn baby grows in a sac called the "bag of waters". The reason the unborn baby does not drown in this water is:<br>A. The baby comes up for air.<br>B. The unborn baby does not need its mouth and nose and lungs to breathe.<br>C. The unborn baby wears an oxygen mask.<br>D. None of the above. |

The answers to these "3 MOVE QUESTIONS" are also set forth in answer booklet 94 and the answers to these representative samples of the "3 MOVE QUESTIONS" are set forth below in Table VIII.

TABLE VIII

| ANSWERS TO 3 MOVE QUESTIONS | |
|---|---|
| CARD NO. | ANSWER |
| 7 | True. Since many parents are uncomfortable about providing sex education to their children and since many schools are only now beginning to provide comprehensive sex education programs in the higher grades, most youngsters naturally look to friends and peers for information about sexual feelings and behavior. This reality, unfortunately, helps to perpetuate the myths and misinformation concerning human sexuality that abounds in this population. |
| 8 | False. Since most boys and girls have concerns and questions about human sexuality long before the onset of puberty, the process of parent-child communication in this area should begin when the child asks his or her first question about sexual matters. |
| 14 | B is correct. At a certain time, different for each boy or girl, a biological alarm clock is set off in the brain which results in the secretion of hormones (chemicals) which begins the process of physical and sexual maturation.<br>A is incorrect. This process is widely known. |
| 23 | A is correct. The umbilical cord is the connection between the mother and the unborn baby. After a baby is born, the umbilical cord is cut. The place where this cut is made is known as the navel or bellybutton. |
| 31 | C is correct. Mental or physical problems of the unborn baby can be attributed to: disease that the mother contracts during pregnancy, like German measles; drugs or chemicals that the mother takes during pregnancy, like thalidomide or barbituates. Genetic factors, or heredity, may also be responsible for various disorders, like Mongolism, hemophilia, Tay Sacks, or Sickle Cell anemia.<br>A and B are incorrect. Because both answers are only partially correct. |
| 32 | A is correct. An incubator is a machine in a hospital that a premature baby is placed into. The baby grows in the incubator until it is big enough to go home with its parents. An incubator is an artifical container that provides a safe and controlled environment for a baby born before term.<br>B is incorrect. Heart-Lung machines are used when a person cannot breathe on their own.<br>C is incorrect. X-ray machines are used to take pictures of internal body structures. |
| 33 | B is correct. Prior to birth, the developing baby gets its oxygen through the umbilical cord, the connection between itself and the mother.<br>A is incorrect. The unborn baby never uses its mouth, nose, or lungs for breathing.<br>C is incorrect. Breathing aids, like oxygen masks, are never needed by the unborn. |

Figures 7, 8, 9, 10:
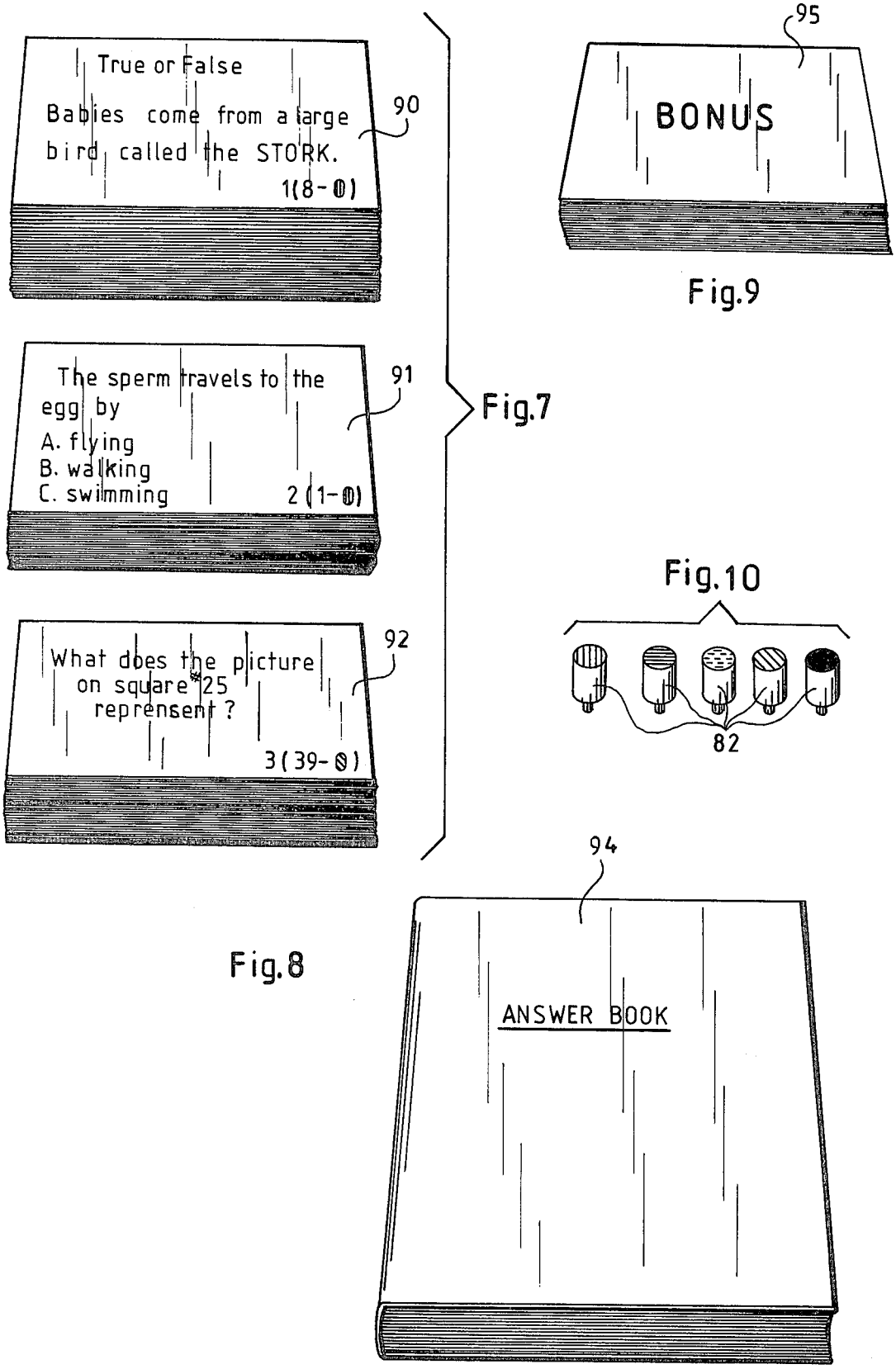
FIG. 7 is a perspective view of three other decks of question cards used in association with the game board.
FIG. 8 is a perspective view of an answer book for the question and discussion cards.
FIG. 9 is a perspective view of a deck of bonus cards used in association with the game board.
FIG. 10 is a perspective view of a plurality of colored pegs used in association with the score sheet of FIG. 5.

Aside from purely verbal or written questions, the questions contained on the cards from decks 40, 41, 42 and 43 may refer to one of the illustrated spaces such as space 25 which is used in association with the question set forth on top of deck 92 in FIG. 7. Such questions typically require a response directed to the identification or explanation of the picture or a part thereof. In addition, the picture may be used by a player to clarify their thinking before making a final response to any questions.

As can be seen in FIGS. 6 and 7, the lower right hand corner of each of the various cards 90, 91, 92 and 93 contain a numeric and color dot reference code notation. The first number outside of the parentheses stands for the level of difficulty (1 representing the "1 MOVE QUESTIONS", 2 the "2 MOVE QUESTIONS", 3 the "3 MOVE QUESTIONS", and 4 the "DISCUSSION QUESTIONS"). The number inside the parentheses identifies the specific card or question number so as to provide the players with easy access to the printed answers. The colored dot separated from this number by a hyphen (-) is simply the color coding for the category that the question falls under and which can be found on the score sheet.

Turning now to the playing of the game, the winner is the first player who makes one complete trip around the board, starting and finishing on space 11. If desired, the game can be lengthened so as to require two or more trips around the board. This decision should, of course, be made before the game is started.

For children aged 8–15, at least one parent-adult must be present. One of the participating players is chosen to assume the role of "Answer Guide and Discussion Reader". The "Answer Guide and Discussion Reader" has final decision over the completeness of answers given to the questions. All answers are to be checked in answer book 94 by the "Answer Guide and Discussion Reader" and the correct answer is to be read out loud.

When there are two or more children, everyone initially picks a token 65 to mark their moves about the board. Then the die 66 is thrown to determine who goes first. As previously noted, the person who throws the highest number goes first, the person throwing the second highest number goes second, etc.

The player who is to proceed first uses the spinner 27 in order to determine whether to pick a question from stack 60, 61, or 62. If the arrow 69 on the spinner 67 lands on a number 1 the player must choose a question from stack 60, which are level 1 questions. If the arrow lands on a number 2, the player must pick a question from stack 61, which are level 2 questions, and if the arrow lands on a number 3, the player must pick a question from stack 62, which are level 3 questions. The spaces numbered 1, 2, and 3 are preferably color coordinated with the cards of stacks 60, 61, and 62 respectively, so as to facilitate easy recognition of the proper stack to choose from. For example, space #1 and deck 60 may be colored blue, space #2 and deck 61 may be colored red, and space #3 and deck 62 may be colored yellow.

If the arrow lands on a line separating two sectors the player must spin again until the arrow lands to one discrete sector on spinner 27. When spinner 27 is used, arrow 29 must be spun vigorously to allow for at least one complete rotation around all the sectors before it comes to rest on one discrete sector. If the question is answered correctly, the player advances his marker the number of playing spaces that correspond to the level of difficulty of the question. For example, if the question is a 2 MOVE QUESTION and the player answers correctly, the token may be moved two spaces. If the question is answered incorrectly, the token remains where it is. In the playing of this game, it is important that all questions be read aloud so that all players are to some extent involved in each question and answer. When one of the players lands on one of the corner DISCUSSION spaces 20, 31, 40, he chooses one of the DISCUSSION cards 63. The purpose of these discussion questions is to encourage communication between parents and children concerning specific attitudinal issues in the area of sexual learning. The player automatically advances one square after completing the discussion task. Suggested answers can be found in the answer booklet 94 which is to be used as a guideline when needed. However, since the questions concern attitudes and values, there are no absolute right or wrong answers.

When one player lands on one of the playing spaces 18, 23, 37 and 47 marked "SPINNER", the player uses spinner 67 immediately to take an extra turn; spinner 67 is used in the same manner as described above. When a player lands on a playing space 18, 30, 35, or 42 marked "DOUBLE SPINNER", that player has the following options to choose from before the player relinquishes his or her turn: (1) to accept the option and possibly be awarded or penalized double the value of the number spaces indicated by the spinner, or (2) decline the option completely. If the player accepts the option, he uses the spinner as previously described. If the question is answered correctly, the player moves forward double the number of spaces indicated on spinner 67 (which corresponds to the level of difficulty of the question answered). If, however, the question is answered incorrectly, the player must move his or her marker backward double the number of spaces indicated by the spinner and level of difficulty of the question. If, on the other hand, the player declines the option completely, the player's token remains where it is until the player's next turn to play.

When one player lands on a playing space 29, 34, 44, or 49 marked "Lose Your Turn", that player may not use the spinner or advance his or her marker in any way until the player's turn comes up in the next rotation of play. When a player lands on a square 26 or 29 marked "BONUS", that player automatically receives a BONUS CARD. When one lands on any other square with directions, the instructions are carried out before the player completes his or her turn.

If there are a number of parents and children playing the game, for example, two parents and two children, teams may be formed and made up of one child and one adult, and for which one marker 65 is used for each team. Discussion among team members is allowed in forming answers. One player takes the role of "Answer Guide and Discussion Reader" and must look up all the answers. Otherwise, the rules remain the same.

When only one child is available for playing, the game can also be utilized as a tool for education and discussion. Rather than set up an unequal, competitive situation between parent and child, the parent may assume the role of "Answer Guide and Discussion Reader Non-Player". If, however, competition gaming aspects are necessary to maintain the child's interest in playing the game, it is suggested that there be a time limit imposed of anywhere between ten and thirty minutes to make a complete trip around the board, and that there be a question requiring a single player to advance around the board to the finish by answering fifteen or less questions.

The game can be played with any number of combination of adults and children (for example, one adult and one or two children, two adults and one child, etc.). Rather than set up an unequal, competitive situation between adults and children, the following options for play of the game may be exercised:

1. Adults and children place their marker on the start square and therefore play the game even-up;
2. The players mutually agree upon an advanced placement or lead for the child or children to begin play of the game. The starting position of the child's marker may be determined by his or her age or knowledge base. The decision where to place each child's marker in order to allow for an equal competitive situation between adults and children is a dynamic one and will most probably be adjusted as the game is played. For example, a child's marker may be initially placed on the Second Discussion Square (space 31) or on the First Discussion Square (space 20), and after the first few playings of the game it is discovered that the child is always or never getting to the Finish first or last. At that point, the lead given to the child can be adjusted accordingly. It should also be noted that if two or more children of different ages or different knowledge bases are playing the game, the younger or less knowledgeable child will most probably be given a longer lead than the older or more knowledgeable child;

3. All players start even up on the "Start" square however, the adult or adults must make two complete trips around the board to the child or children's one in order to be considered the winner; and as a final option,
4. Adult assumes the role of non-player "Reader-Advisor". In this situation the adult does not choose a marker or move around the board but functions as overseer of play of the game between the children. The only questions the adult participates in are The Discussion Questions (#63). Under this option, when only one child is available for playing, the game may be utilized as a tool for education and discussion. If, however, competition gaming aspects are necessary to maintain the child's interest in playing the game, it is suggested that a time limit be imposed of 20–40 minutes to make a complete trip around the board, and that there be a question limit requiring a single player to advance around the board to the finish by answering 20 or less questions.

In conjunction with the answering of the questions, each player is provided with a score sheet 80 which is divided into several categories arranged by column. Each column contains a multiplicity of peg-holes 81. The category headings are each provided with a differently colored category dot which corresponds to category color dots printed on the front of each level question card and all discussion cards. If a player answers correctly, they place a colored peg 82 in a peg hole 81 under the appropriate category heading on their score sheet. When a player has amassed five marks in the Anatomy and Physiology, or Conception, Pregnancy and Childbirth, Miscellaneous, or Puberty and The Life Cycle sections, or four marks in the Relationships and Sex Roles section, the player's pegs for that category are turned in and the player is awarded a Bonus Card 95. A player can also be awarded a Bonus Card 95 if the player's token 65 lands on a playing space 26, 39 marked "Bonus" regardless of the number of pegs they have in any one category. The player with the bonus may then choose to use it at any time during the course of the game. The player must announce when they are ready to use their extra moves and they also do so at the start of their regular turn. The bonus is taken in addition to the player's regular turn. The player may indicate that they are ready to use their bonus by turning in their bonus card. There are a number of options for using the bonus: one, to advance or move back one, two or three board spaces, the bonus being considered used up regardless of the number of spaces chosen; or two, to advance or move back another player's token one, two or three board spaces. By the latter alternative, the player with the bonus may choose to use it as a way of thwarting other players' movement around the board. Here again, the bonus is considered used up regardless of the number of squares or spaces an opposing party is forced to move backward or forward. It is possible for a player to be awarded more than one bonus as long as they have amassed the needed number of category marks. However, in the event that a player amasses more than one bonus, the player may use one bonus per turn. The players are also permitted to inspect their opponents' category score sheets in order to plan their game strategy. Of course, it should be realized that the number of categories may be changed if desired. For instance, the Miscellaneous section could be deleted.

While only one embodiment of the present invention has been shown and described, it will be obvious that many modifications and changes may be made thereunto, without departing from the spirit and scope of the invention.

What is claimed is:

1. A family sex education board game apparatus comprising:

a plurality of tokens, each of which represent one of the players;

a game board having a playing field and a multiplicity of playing spaces formed on said playing field which cooperatively define a continuous path along which said tokens are movable in random increments, said playing spaces including a starting and finishing space and at least four different sets of spaces, a first set of spaces interspersed along said path having instructions thereon concerning the loss of a turn, a second, third and fourth set of spaces interspersed along said path, each of which has identical indicia thereon which is different from the indicia of the other sets;

three decks of cards, each card in each of said decks having a question thereon concerning the field of human sexuality, the cards in the same deck having questions of relatively the same difficulty and the cards in the different decks have questions of various levels of difficulty, each deck divided into a plurality of subdecks having questions thereon directed to a particular category of human sexuality, the categories being the same between said three decks, each of the cards of each one of the categories identified by indicia common to that category and distinct from the indicia on the cards of the other categories;

a fourth deck of cards associated with said fourth set of playing spaces, each of which contain a question for discussion among the players in the field of human sexuality;

a spinner device associated with said second and third sets for playing spaces which includes a base plate having a plurality of radially-arranged spaces thereon, each of which bear a number concerning movement of the player's token which lands on one of said spaces of said second and third sets, and a spinner rotatably mounted on said base plate for randomly selecting one of said spaces on said base plate;

an answer booklet containing the answers to the questions set forth in said four decks of cards; and a category score sheet for scoring one's correct answers according to various categories of human sexuality the score sheet categories having indicia thereon corresponding to the indicia on the cards within the said subdeck categories.

2. The board game apparatus according to claim 1, additionally including a random number generator for determining the order of play among the players.

3. The board game apparatus according to claim 2, wherein said randon number generator comprises a die.

4. The board game apparatus according to claim 1, wherein said game board has four boxes delineated in the center thereof for receipt thereon of said four decks of cards and wherein the cards of the different decks are colored differently and are sequentially numbered.

5. The board game apparatus according to claim 4, wherein said radially-arranged spaces comprise a total of six spaces each numbered 1, 2, 3, 1, 2, 3, respectively, and wherein the spaces number 1, 2, and 3 are color-coordinated to the first, second, and third decks of cards, respectively.

6. The board game apparatus according to claim 1, wherein said category score sheet is divided into a plurality of columns which bear different category headings concerning human sexualtiy.

7. The board game apparatus according to claim 6, wherein said columns of said score sheet each has a multiplicity of peg holes formed therein and wherein said apparatus additionally includes a set of differently colored pegs for each of the players for inserting into said peg holes.

8. The board game apparatus according to claim 7, wherein said multiplicity of playing spaces includes a fifth and sixth set of playing spaces, and additionally including a fifth deck of cards, said fifth set of playing spaces having identical indicia thereon which is different from the indicia of the other sets and being associated with said fifth deck of cards, the cards of which each represent a bonus move, and wherein said sixth set of playing spaces each has a picture thereon, at least one of which is associated with the questions set forth in said three decks of cards.

* * * * *